US010399104B2

(12) United States Patent
Lefevre et al.

(10) Patent No.: US 10,399,104 B2
(45) Date of Patent: Sep. 3, 2019

(54) RETRACTABLE COVERING ELEMENT AND PRODUCT PACKAGING AND APPLICATION ASSEMBLY EQUIPPED WITH SUCH A SYSTEM

(71) Applicant: Parfums Christian Dior, Paris (FR)

(72) Inventors: Savine Lefevre, Compiegne (FR); François Gautier, Colombes (FR)

(73) Assignee: PARFUMS CHRISTIAN DIOR, Paris (FR)

( * ) Notice: Subject to any disclaimer, the term of this patent is extended or adjusted under 35 U.S.C. 154(b) by 0 days.

(21) Appl. No.: 14/654,392

(22) PCT Filed: Dec. 19, 2013

(86) PCT No.: PCT/FR2013/053188

§ 371 (c)(1),
(2) Date: Jun. 19, 2015

(87) PCT Pub. No.: WO2014/096718

PCT Pub. Date: Jun. 26, 2014

(65) Prior Publication Data

US 2015/0367367 A1 Dec. 24, 2015

(30) Foreign Application Priority Data

Dec. 21, 2012 (FR) ..... 12 62579

(51) Int. Cl.
*B05B 11/00* (2006.01)
*B65D 50/06* (2006.01)
(Continued)

(52) U.S. Cl.
CPC ..... *B05B 11/3047* (2013.01); *B05B 11/0032* (2013.01); *B05B 11/3001* (2013.01);
(Continued)

(58) Field of Classification Search
CPC ..... B05B 11/0032; B05B 11/3001; B05B 11/3042; B05B 11/3047; B05B 11/3059;
(Continued)

(56) References Cited

U.S. PATENT DOCUMENTS 5,096,094 A * 3/1992 Guilbert ..... B05B 11/3001 222/153.13
5,562,219 A * 10/1996 de Pous ..... B05B 11/3049 215/274

(Continued)

FOREIGN PATENT DOCUMENTS

DE 20 2008 010757 U1 10/2008
EP 2 127 554 A1 12/2009

(Continued)

OTHER PUBLICATIONS

International Search Report Application No. PCT/FR2013/053188 report dated Feb. 28, 2014.

*Primary Examiner* — Frederick C Nicolas
*Assistant Examiner* — Bob Zadeh
(74) *Attorney, Agent, or Firm* — Miller, Matthias & Hull LLP

(57) ABSTRACT

The present invention concerns a retractable covering system suitable for covering a handling element protruding from the neck of a product reservoir. In the system, an assembly ring defines a longitudinal axis and an axial direction. A cap is translatable along the longitudinal axis relative to the assembly ring between a deployed position, in which it extends substantially protruding relative to the ring, and a retracted position, in which it is at least partially retracted relative to the ring. An elastic element biasing biases the cap toward the deployed position and a reversible locking device locks the cap in the retracted position.

11 Claims, 3 Drawing Sheets

(51) Int. Cl.
*B65D 55/02* (2006.01)
*B65D 41/00* (2006.01)
*B65D 53/02* (2006.01)

(52) U.S. Cl.
CPC ..... *B05B 11/3059* (2013.01); *B65D 41/005* (2013.01); *B65D 50/065* (2013.01); *B65D 53/02* (2013.01); *B65D 55/02* (2013.01); *B05B 11/3042* (2013.01)

(58) Field of Classification Search
CPC .... B65D 41/005; B65D 50/065; B65D 53/02; B65D 55/02
See application file for complete search history.

(56) References Cited

U.S. PATENT DOCUMENTS 6,290,103 B1 * 9/2001 Fraillon ..... B65D 47/244 222/321.1
7,775,402 B2 * 8/2010 Yoshida ..... B05B 11/3059 222/153.13
7,984,830 B2 * 7/2011 Stradella ..... B65D 83/386 128/200.21
8,348,102 B2 * 1/2013 Stradella ..... B65D 83/386 128/200.21
8,490,837 B2 * 7/2013 Michaux ..... B65D 83/22 222/153.13
8,695,852 B2 * 4/2014 Bertin ..... B05B 11/0032 222/153.13
2003/0010793 A1 * 1/2003 Ritsche ..... B05B 11/3059 222/153.1
2013/0306681 A1 * 11/2013 Muller ..... B05B 11/0016 222/321.9
2015/0367367 A1 * 12/2015 Lefevre ..... B65D 50/065 222/153.13

FOREIGN PATENT DOCUMENTS

FR 2 871 712 A1 12/2005
FR 2 882 349 A1 8/2006

* cited by examiner

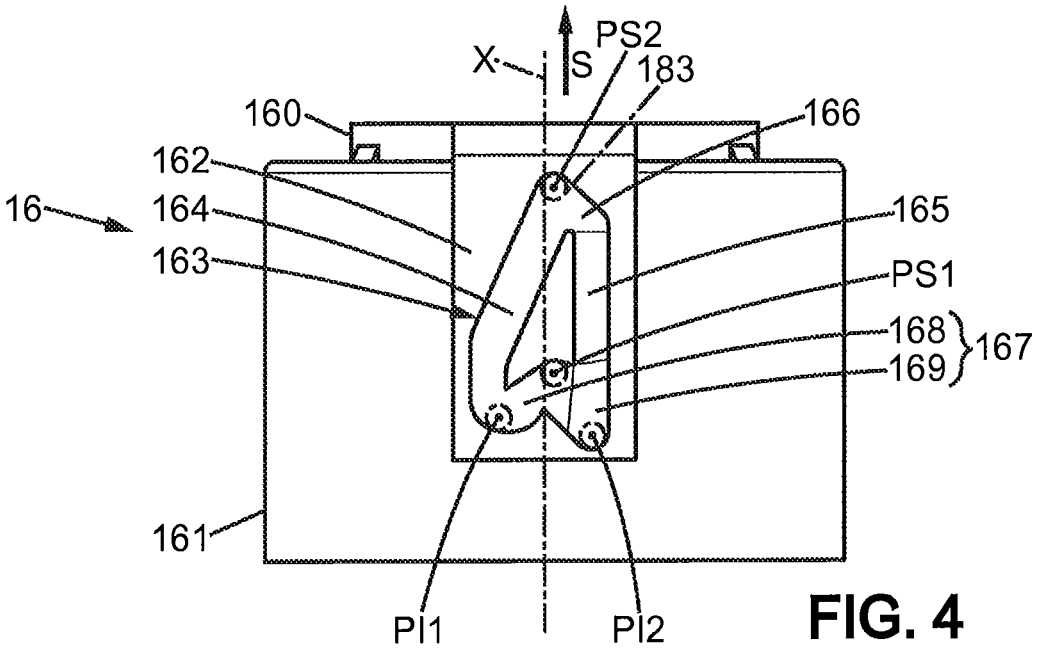
FIG. 4
FIG. 5
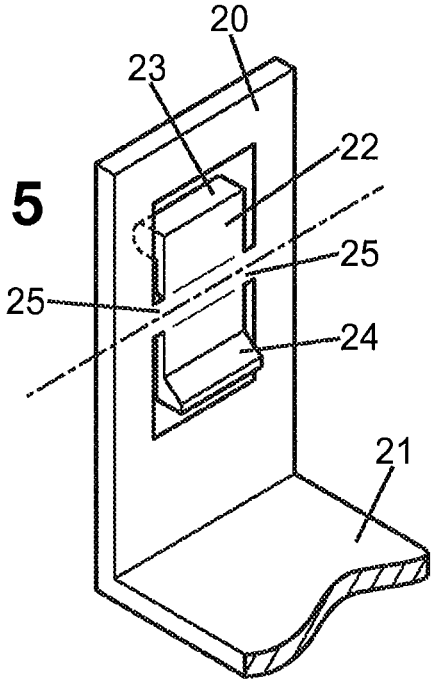

RETRACTABLE COVERING ELEMENT AND PRODUCT PACKAGING AND APPLICATION ASSEMBLY EQUIPPED WITH SUCH A SYSTEM

CROSS-REFERENCE TO RELATED APPLICATION

This Application is a 35 USC § 371 US National Stage filing of International Application No. PCT/FR2013/053188 filed on Dec. 19, 2013, and claims priority under the Paris Convention to French Patent Application No. FR 12 62579 filed on Dec. 21, 2012.

FIELD OF THE DISCLOSURE

The present invention relates to a retractable covering system suitable for covering a handling element protruding from the neck of a product reservoir, and to a product packaging and application assembly, particularly for a cosmetic, personal care, or pharmaceutical product, equipped with such a system.

BACKGROUND OF THE DISCLOSURE

More particularly, the invention relates to a retractable covering system suitable for covering a handling element protruding from the neck of a product reservoir, said system comprising:

- an assembly ring, having a first longitudinal end intended to be placed facing the reservoir and a second free longitudinal end, and defining a longitudinal axis and an axial direction from the first end to the second end; and
- a cap that is movable along the longitudinal axis relative to the assembly ring, between a deployed position where said cap substantially protrudes in the axial direction relative to said ring and a retracted position where said cap is at least partially retracted in the direction opposite to the axial direction relative to said ring.

Document EP0987189 describes an example of such a system, implemented in a manner that selectively covers and uncovers a spray head protruding from the neck of a product reservoir. In this document, the assembly ring is fixed at the neck of the product reservoir and the movement of the cap between the deployed position and the retracted position is controlled by means of a rotatable ring concentrically attached to the assembly ring and which a user can actuate. When actuated, the rotatable ring drives the cap which has radial pins extending inward and engaging with respective helical tracks provided in the assembly ring so as to selectively drive the cap between its deployed and retracted positions and to cover and uncover the product spray head.

Such a covering system with rotatable control is not entirely satisfactory, particularly from the standpoint of ergonomics and ease of use. The system described in the aforementioned document requires the user to use both hands and/or to make several attempts in order to move the cap between its deployed and retracted positions.

Furthermore, in such a system, the friction existing between the cap and the fixed ring, in particular between the radial pins of the cap and the helical tracks provided on the fixed ring, or between the cap and the rotatable control ring, can be relatively significant and interfere with the ease of use of the retractable covering system.

Lastly, when the covering system disclosed in the above document is mounted on the neck of a product reservoir, it is necessary to provide an operating clearance between the rotatable control ring and the shoulder of the reservoir, which impacts the aesthetics of the assembly and creates a risk of fouling that could interfere with the proper functioning of the covering system.

The present invention is intended to overcome these disadvantages and aims to provide a retractable covering system that is simple and intuitive to use, reliable, and not detrimental to the aesthetics of the product packaging and application assembly when it is placed on the neck of a product reservoir for selectively covering a handling element projecting therefrom.

SUMMARY OF THE DISCLOSURE

To this end, according to the invention, a product packaging and application assembly of the aforementioned type is characterized in that it further comprises:

- an elastic element biasing the cap towards the deployed position; and
- a reversible locking device to lock the cap in the retracted position.

With these arrangements, the invention provides a retractable covering system that is simple, reliable, and ergonomic, and is particularly intuitive to use.

In particular, in the system according to the invention, the movement of the cap between the deployed position and the retracted position, or in other words from the deployed position to the retracted position and vice versa, is achieved by acting directly with manual pressure on the cap, this operation able to be performed using a single hand and in a manner that is particularly intuitive for the user.

In preferred embodiments of the invention, one or more of the following arrangements may possibly be used:

- the cap is guided relative to the ring such that the movement of said cap is a translational movement with no rotation;
- the reversible locking device defines at least a first stable position of the cap relative to the ring, corresponding to the retracted position, and at least a first unstable position located beyond the retracted position in the direction opposite to the axial direction, and the passage of the cap from the deployed position to the retracted position is achieved by a movement of said cap relative to the ring in the direction opposite to the axial direction until it reaches the first unstable position, followed by a movement of the cap relative to the ring in the axial direction caused by the elastic element;
- the reversible locking device defines a second stable position of the cap relative to the ring, corresponding to the deployed position, and a second unstable position located beyond the retracted position in the direction opposite to the axial direction, and the passage of the cap from the retracted position to the deployed position is achieved by a movement of said cap relative to the ring in the direction opposite to the axial direction until it reaches the second unstable position, followed by a movement of the cap relative to the ring in the axial direction caused by the elastic element;
- the reversible locking device comprises at least one follower pin integral to one among the assembly ring and cap and engaging with a heart-shaped cam integral to the other among the assembly ring and cap;

the elastic element is in the form of a spring having a first end bearing against the ring and a second end bearing against the cap.

According to an advantageous arrangement of the invention, the reversible locking device comprises at least one flexible tab having a free end provided with the follower pin, said flexible tab being inclined towards the longitudinal axis such that said follower pin exerts an elastic force in the radial direction on the heart-shaped cam. By means of these arrangements, the gaps that may exist between the assembly ring and cap, in particular those due to the manufacturing tolerances of both elements, for example made of injected plastic, can advantageously be compensated for by the elastic force generated between these two parts in the reversible locking device.

Preferably, the locking device comprises two diametrically opposite flexible tabs, each having a free end provided with a follower pin engaging with a respective heart-shaped cam, said flexible tabs being angled towards the longitudinal axis so that each of said follower pins exerts an elastic force in the radial direction on said respective heart-shaped cam. This has the effect of self-centering the cap relative to the assembly ring, in addition to compensating for any gaps that may exist in the assembly of these two elements.

According to another advantageous arrangement of the invention, as the handling element is movable relative to the neck of the reservoir between a rest position and a usage position, the retractable covering system further comprises a locking device that locks the handling element in the rest position when the cap is in the deployed position, the passage of said cap into the retracted position causing the unlocking of said handling element. This prevents usage of the handling element as long as the cap is in the deployed position where the handling element is covered.

Preferably, this locking device for the handling element comprises at least one tiltable tongue integral to the assembly ring and having a locking portion, an unlocking portion, and a tilt axis, said locking and unlocking portions extending to each side of the tilt axis, the locking portion engaging with the handling element when the cap is in the deployed position, and said cap being brought into engagement with the unlocking portion when passing from the deployed position to the retracted position so as to cause the tongue to tilt on the tilt axis and the locking portion to disengage from the handling element.

Advantageously, the locking device further comprises a tab integral to the ring and extending substantially along the longitudinal axis, and the tilt axis of the tiltable tongue is formed by at least one bridge of material connecting said tab and said tiltable tongue.

In one particular embodiment, the locking portion comprises a lug extending radially inward and the unlocking portion comprises a ramp extending radially outward.

The invention also proposes a product packaging and application assembly comprising:

a product packaging and application system comprising:

a product reservoir having a neck extending along a longitudinal axis and having an open free end, a shoulder, a side wall, and a bottom, said shoulder radially connecting said neck to said side wall; and a product application device having a collection portion intended to be inserted through the open free end of the neck so as to extend at least partially inside the reservoir, for collecting product contained therein, and a handling element protruding from said neck along the longitudinal axis and adapted to be manipulated by a user in order to act on the collection portion and cause product to exit the reservoir;

a retractable covering system as described above, wherein:

the assembly ring is concentrically fixed to the neck of the reservoir; and the cap laterally covers the handling element in the deployed position and at least partially uncovers said handling element in the retracted position.

An assembly is thus proposed comprising a product packaging and application system equipped with a compact retractable covering system, extending from the neck of the product reservoir and allowing a simple and intuitive selective covering and uncovering of a handling element protruding from said neck.

In a particularly advantageous embodiment of the invention, the application device is a product dispensing device for product contained in the reservoir, the collection portion comprising a pump fixed to the neck of the reservoir, and the handling element comprising a pushbutton that is movable relative to the pump between a rest position and a pump actuation position.

In an advantageous arrangement of the invention, the pump is fixed to the neck of the reservoir by means of a ferrule engaged around and over the open free end of the reservoir neck, the assembly ring being fixed to said neck at least by being engaged around said ferrule.

By means of these arrangements, with the assembly ring being fixed to the neck of the reservoir by the pump attachment ferrule, the retractable covering system according to the invention can advantageously be used on reservoirs having differently shaped cross-sections, for example cylindrical, square, rectangular, or trapezoidal, with different sizes of reservoir neck, by being adapted to the pump attachment ferrule.

In general, the invention is not limited to a given reservoir shape, such as the cylindrical shape described in detail below, which allows for a wide degree of freedom in terms of aesthetics for both the retractable covering system and the packaging and application assembly, alone or in combination.

Alternatively, it may be arranged that the application device is an applicator for the product contained in the reservoir, for example a cosmetic product such as mascara, lip gloss, or nail polish, the collection portion then comprising a wand which has a free end equipped with an applicator head intended to be loaded with product and an end connected to a gripping element which forms the handling element and which closes off the reservoir when in the rest position. In this case, the usage position of the gripping member corresponds to a position where it is disengaged from the neck of the reservoir along the longitudinal axis and where the collection portion comprising the wand and applicator head loaded with product is withdrawn from said reservoir in order to apply the product onto a surface, for example skin, lips, nails, and/or keratin fibers (eyelashes, eyebrows, hair, etc.).

Other features and advantages of the invention will become apparent from the following description of one of its embodiments, given by way of non-limiting example with reference to the accompanying drawings.

BRIEF DESCRIPTION OF THE DRAWINGS

In the drawings:

FIG. 4 shows a detail view of the reversible locking device equipping the covering system according to the invention;

FIG. 5 illustrates a detail view of the locking device of the handling element in the rest position, equipping the covering system according to the invention.

In the various figures, the same references designate identical or similar elements.

DETAILED DESCRIPTION OF THE DISCLOSURE

Figure 1:
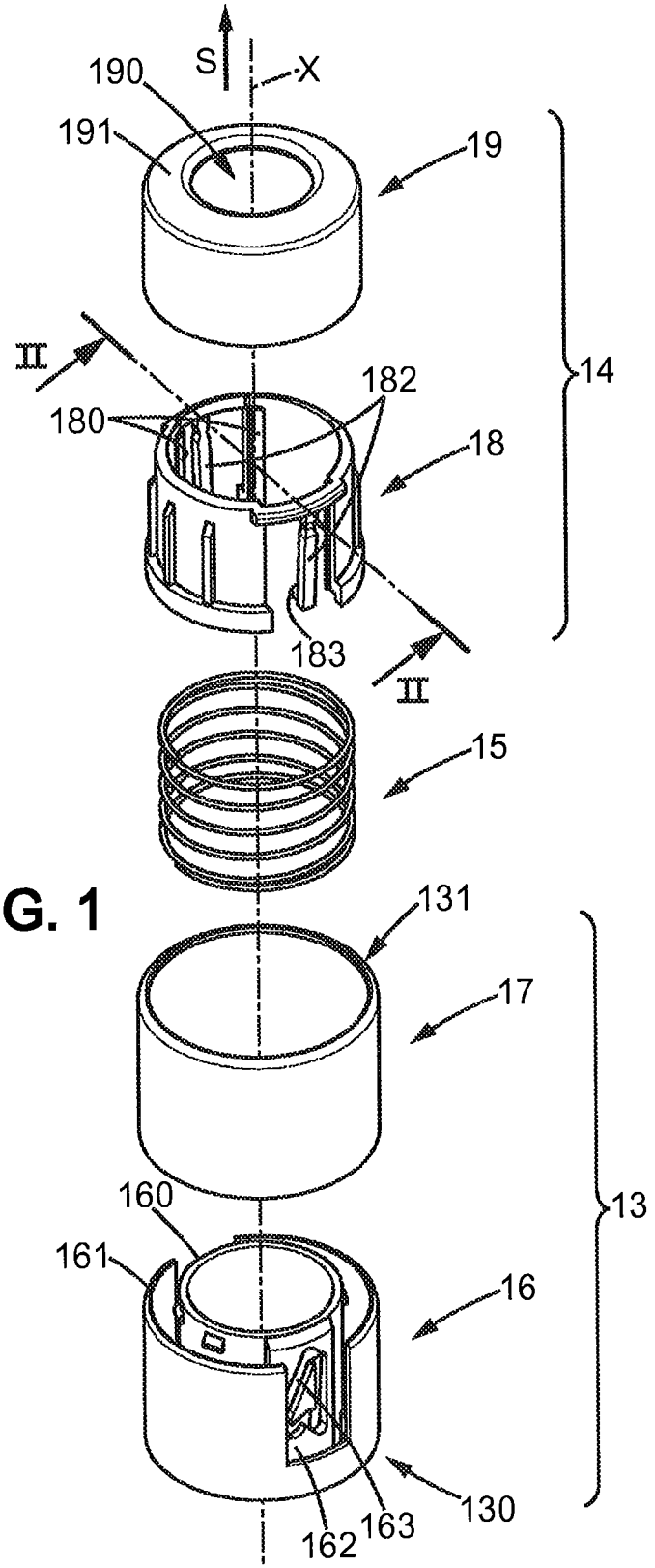
FIG. 1 is an exploded perspective view of the retractable covering system of the invention.

In FIG. 1, a covering system according to the invention is represented in an exploded perspective view, where the handling element of the locking device is not shown for reasons of clarity. It will be described in more detail in relation to FIGS. 2, 3 and 5.

Figure 2:
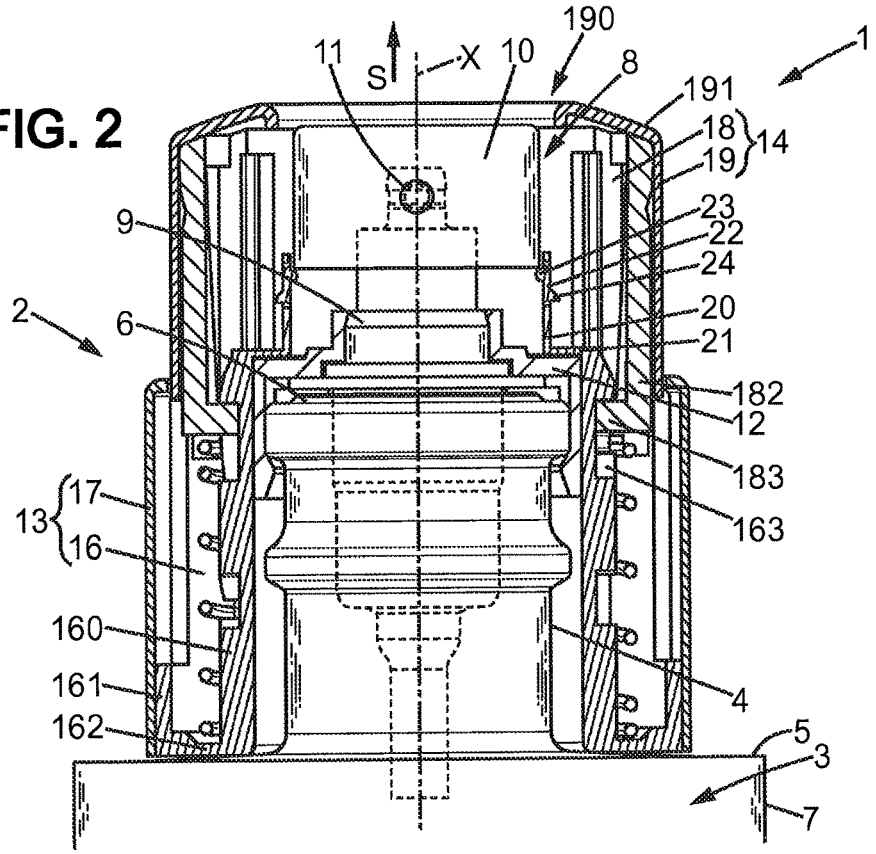
FIG. 2 is a sectional view along line II-II of FIG. 1, illustrating the retractable covering system in place on the neck of a product reservoir, the cap being in the deployed position.

As represented in FIG. 2, the invention relates to a product packaging and application assembly 1 equipped with a retractable covering system 2.

The packaging assembly 1 is, for example, intended for applying a liquid or paste cosmetic, personal care, or pharmaceutical product. It comprises a product reservoir 3 having a neck 4 extending along a longitudinal axis X, said neck 4 extending from a shoulder 5 of the reservoir 3 to a free open end 6. The shoulder 5 is located at the upper end of a side wall 7 of the reservoir.

The packaging assembly 1 further comprises a product application device 8, comprising:

- a collection device 9, for example a pump suitable for dispensing the product concerned, inserted through the neck 4 of the reservoir in order to collect the product contained therein,
- and a handling element 10, for example a pushbutton projecting above the upper end 6 of the neck and supported by an actuating rod mounted so as to slide along the longitudinal axis X at the upper end of the pump 9, said actuating rod being adapted to actuate the pump 9 and thereby cause the product to be dispensed, for example through a dispensing or spray nozzle 11 integrated into the push button 10.

Figure 3:
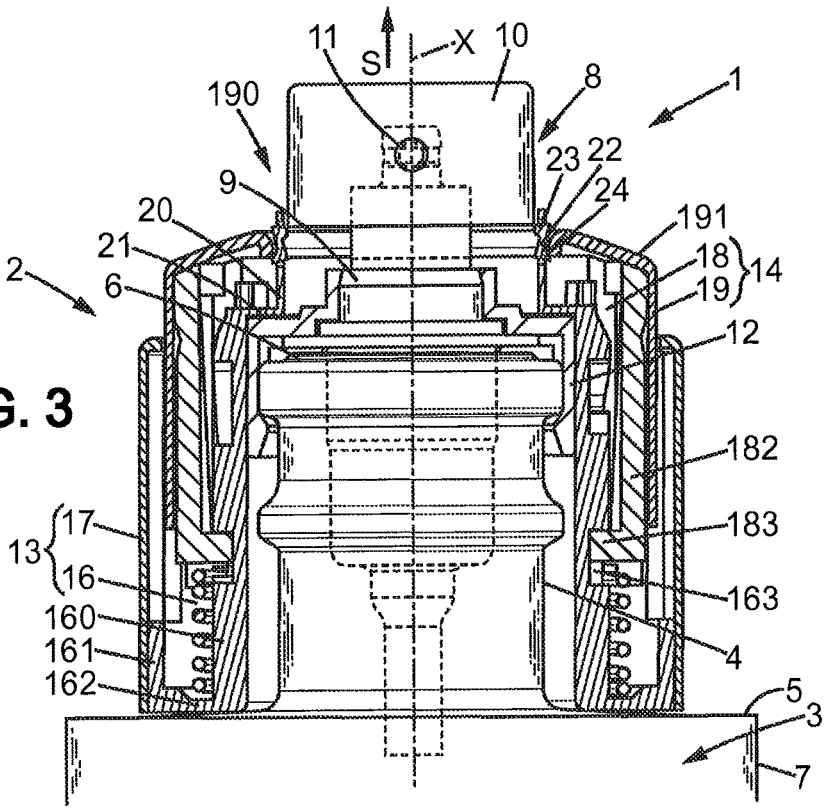
FIG. 3 is a sectional view along line II-II of FIG. 1, illustrating the retractable covering system in place on the neck of a product reservoir, the cap being in the retracted position.

The pushbutton 10 is thus axially movable between a rest position, shown in FIGS. 2 and 3, and a position allowing pump 9 actuation, where the pushbutton has been pressed towards the neck 4 of the reservoir 3.

The pump 9 is mounted on the neck 4 of the reservoir by means of a ferrule 12, made for example of plastic or other material, which fits onto and around the upper end 6 of the neck 4. This ferrule 12 may, for example, be attached to the neck 4 by snap-fitting or by any other means.

The neck 4 of the reservoir and the application device 8 are normally hidden by said retractable covering system 2.

As can be seen in FIGS. 1 and 2, the retractable covering system 2 comprises:

- an assembly ring 13 that fits around the ferrule 12 by being concentrically mounted onto the neck 4 of the reservoir 3,
- a cap 14 that is movable, along the longitudinal axis X relative to the assembly ring 13, between a deployed position visible in FIG. 2 where said cap 14 essentially protrudes relative to the ring 13 and laterally covers the pushbutton 10, and a retracted position visible in FIG. 3 where said cap 14 is at least partially retracted relative to the ring 13 and at least partially uncovers the pushbutton 10 in the axial direction X,
- an elastic element 15, for example a compression spring, biasing the cap 14 in the deployed position, and
- a reversible locking device, which will be described below and which is suitable for locking the cap 14 in the retracted position.

The assembly ring 13 has a first longitudinal end 130 that is open in the axial direction X and is adapted to be placed facing the reservoir 3, and a second longitudinal end 131 that is open and free in the axial direction X, and defines a longitudinal axis X and an axial direction S from the first end 130 to second end 131.

This assembly ring 13 comprises a fixed insert 16 intended to be fastened around the neck 4 of the reservoir 1 so that it rests on the shoulder 5 of the reservoir, as well as a trim element 17 provided to be fit tightly around the fixed insert 16. The fixed insert 16 may, for example, be made of plastic, and the trim element 17 may be made of metal.

In the embodiment illustrated, the fixed insert 16 is in the form of a generally cylindrically element comprising a first radially inner skirt 160 engaging around and above the ferrule 12 that mounts the pump 9 on the neck of the reservoir 3, a second radially outer skirt 161 onto which the trim element 17 is fitted, for example by press-fitting, and an annular portion 162 radially connecting the lower ends of the first and second skirts 160, 161 and pressing against the shoulder 5 of the reservoir 3.

The cap 14 is mounted so as to be movable along the longitudinal axis X relative to the assembly ring 13 by being received between the first and second skirts 160, 161 of the fixed insert 16. The cap 14 comprises a movable insert 18 which is in the form of a generally cylindrical element open at its axial ends, and a trim element 19 fitted, for example by press-fitting, around said movable insert 18 and having an upper end provided with a through-hole 190 to accommodate the pushbutton 10, and a bearing surface 191 which a user can press in order to move the cap relative to the assembly ring 13 between the deployed position and the retracted position.

As can be seen in particular in FIG. 1, the cap 14 is guided relative to the assembly ring 13 by means of two pairs of longitudinal ribs 180 positioned diametrically opposite on the inner face of the movable insert 18 and engaging with the side faces of the two portions 162 protruding in the radial direction from the outer face of the first skirt 160 of the fixed insert 16, so that movement of the cap 14 relative to the assembly ring 13 is a translational movement with no rotation.

The elastic element 15 is in the form of a helical compression spring having a first end bearing on the fixed insert 16 of the assembly ring 13 and a second end bearing on the movable insert 18 of the cap 14.

The reversible locking device for locking the cap 14 in the retracted position relative to the assembly ring 13 comprises two flexible tabs 182 positioned diametrically opposite on the movable insert 18 of the cap 14 and each having a free end provided with a follower pin 183 which each engage with a heart-shaped cam 163 (an inverted heart-shape in the illustrated embodiment) formed as a recess in each of the protruding portions 162 of the inner skirt 160 of the fixed insert 16.

According to an advantageous embodiment of the invention, the flexible tabs 182 of the movable insert 18 are at least slightly inclined towards the longitudinal axis X so that the follower pins 183 exert an elastic force in the radial direction on the heart-shaped cams 163.

As is particularly visible in FIG. 4, which shows a side view of the fixed insert 16 of the assembly ring 13, each heart-shaped cam 163 forms a continuous track for the movement of the follower pin 183, providing a retraction path 164, a deployment path 165, an upper connecting portion 166 between the retraction and deployment paths 164, 165, and a lower connecting portion 167 between the retraction and deployment paths 164, 165 and formed of first and second segments 168, 169 angled downwards.

Each heart-shaped cam 163 thus defines four specific positions for each follower pin 183 (represented with dashed lines in FIG. 4 for these four specific positions), namely:

- a first stable position PS1 corresponding to the retracted position of the cap 14 relative to the assembly ring 13, where the associated follower pin 183 is received in a manner that is stable and locked in the axial direction S within the lower connecting portion 167 of the heart-shaped cam 163;
- a second stable position PS2 corresponding to the deployed position of the cap 14 relative to the assembly ring 13, where the associated follower pin 183 is received in a manner that is stable and locked in the axial direction S within the upper connecting portion 166 of the heart-shaped cam 163;
- a first unstable position PI1 situated beyond the first stable position PS1 in the direction opposite to the axial direction S, where the associated follower pin 183 is positioned in an unstable manner at the lower end of the first inclined segment 168; and
- a second unstable position PI2 situated beyond the first stable position PS1 in the direction opposite to the axial direction S, where the associated follower pin 183 is positioned in an unstable manner at the lower end of the second inclined segment 168.

In the embodiment illustrated, each heart-shaped cam 163 defines a closed track for each associated follower pin 183, and the locking in the axial direction S of the cap 14 in the deployed position relative to the assembly ring 13 is achieved by the locking device.

Alternatively, it could be arranged so that each heart-shaped cam 163 defines two half-tracks that are open at their upper ends, the locking in the axial direction S of the cap 14 in the deployed position relative to the assembly ring 13 then being achieved by one or more stops provided on the cap 14 and adapted to engage with one or more corresponding stops provided on the assembly ring 13.

Furthermore, and as can be seen in FIGS. 2, 3, and 5, the retractable covering system 2 according to the invention further comprises a locking device provided to lock the pushbutton 10 in the rest position when the cap 14 is in the deployed position relative to the ring 13, and to unlock the pushbutton 10 when the cap 14 is in the retracted position relative to the ring 13 so as to allow displacement of the pushbutton 10 to its pump 9 actuation position.

This locking device comprises two diametrically opposite tabs 20 extending substantially along the longitudinal axis X and connected to the radially inner skirt 160 of the fixed insert 16 via two radial connecting portions 21.

Two cutouts, having C-shapes in this example, are made in each of the tabs 20 in order to define a tiltable tongue 22 having a locking portion formed by a lug 23 extending radially inward, an unlocking portion formed by a ramp 24 extending radially outward, and a tilt axis formed by two bridges 25 of material connecting the tiltable tongue 22 to the tab 20, the lug 23 and the ramp 24 being located on each side of the tilt axis so as to form a tilting system.

The operation of the retractable covering system of the invention will now be described with reference to FIGS. 2 and 3.

In the position illustrated in FIG. 2, the cap 14 is in the deployed position relative to the ring 13 and substantially protrudes in the axial direction S relative thereto so as to laterally cover the pushbutton 10.

In this position, the locking lugs 23 engage with the lower edge of the pushbutton 10 in a manner that prevents its displacement toward the pump 9 actuation position.

Starting from this configuration illustrated in FIG. 2, a user holding in the reservoir 3 in her hand presses on the cap 14 at the bearing surface 191 of the trim element 19, for example using her thumb, which moves said cap 14 in the direction opposite to the axial direction S, against the force exerted by the spring 15.

During this movement, the follower pins 183 leave the defined second stable position PS2 in the heart-shaped cams 163 and travel along the retraction paths 164, causing the flexible tabs 182 to bend until they reach the first unstable position PI1. The follower pins 183 then leave the retraction paths 164 and are forced into the first inclined segments 168 by the elastic return of the flexible tabs 182.

Parallel to this movement of the cap 14, the pushbutton 10 passes through the through-hole 190 formed on the trim element 19 of the cap 14, and the edge of said trim element 19 comes into contact with the unlocking ramps at the through-hole 190, which causes the tiltable tongues 22 to tilt due to the twisting of the bridges of material 25 connecting them to their respective axial tab 20, thus disengaging the locking lugs 23 from the lower edge of the pushbutton 10.

The user then stops pressing the cap 14, which causes movement of the cap 14 in the axial direction S and displacement of the follower pins 183 to the first stable position PS1 due to the relaxation of the spring 15.

In this position illustrated in FIG. 3, the cap 14 is locked in the retracted position relative to the ring 13 and is not covering the pushbutton 10 which can then be pressed towards the neck 4 of the reservoir 3 into the pump 9 actuation position, which causes product contained inside the reservoir 3 to be dispensed.

Once the user is done using the product application device 8 comprising the pump 9 and pushbutton 10, she again presses the cap 14 at the bearing surface 191 of the trim element 19, which moves said cap 14 in the direction opposite to the axial direction S, against the force exerted by the spring 15.

During this movement, the follower pins 183 leave the defined first stable position PS1 in the heart-shaped cams 163 and travel within the second inclined segments 169, causing the flexible tabs 182 to bend until they reach the second unstable position PI2.

The follower pins 183 are then facing the deployment paths 165, and are returned to the second stable position PS2 due to the relaxation of the spring 15 when the user releases the pressure exerted on the cap 14.

At the same time, the edge of the trim element 19 is disengaged from the unlocking ramps 24 at the through-hole 190 and the tiltable tongues 22 are returned to the position which locks the pushbutton 10 by the elastic return of the bridges of material 25.

The product packaging and application assembly 1 equipped with the retractable covering system 2 according to the invention is then once again in the configuration illustrated in FIG. 2, where the pushbutton 10 is hidden by being laterally covered by the cap 14 in the deployed position relative to the ring 13, and is locked in the rest position by the locking lugs 23 engaged with the lower edge of the pushbutton (10).

The invention claimed is:

1. A retractable covering system suitable for covering a handling element protruding from a neck of a product reservoir, said product reservoir having an open free end, a shoulder, a side wall, and a bottom, said shoulder radially connecting said neck to said side wall, said side neck extending along a longitudal axis, the handling element comprising a pushbutton, a pump being fixed to the neck of the product reservoir, the push button being movable relative to the pump between a rest position and a pump actuation position, said system comprising:

an assembly ring intended to be attached concentrically to the neck of the product reservoir, having a first longitudinal end intended to be placed facing the product reservoir and a second longitudinal, end, and defining the longitudinal axis and an axial direction from the first longitudinal end to the second longitudinal end, said second longitudinal end being free;

a cap that is movable along the longitudinal axis relative to the assembly ring, between a deployed position where said cap substantially protrudes in the axial direction relative to said assembly ring and a retracted position where said cap is at least partially retracted in a direction opposite to the axial direction relative to said assembly ring;

an elastic element biasing the cap towards the deployed position; and a reversible locking device to lock the cap in the retracted position.

2. The system according to claim 1, wherein the reversible locking device defines at least a first stable position of the cap relative to the assembly ring, corresponding to the retracted position, and at least a first unstable position located beyond the retracted position in the direction opposite to the axial direction, and wherein a passage of the cap from the deployed position to the retracted position is achieved by a movement of said cap relative to the assembly ring in the direction opposite to the axial direction until said cap reaches the first unstable position, followed by a movement of the cap relative to the assembly ring in the axial direction caused by the elastic element.

3. The system according to claim 2, wherein the reversible locking device defines a second stable position of the cap relative to the assembly ring, corresponding to the deployed position, and a second unstable position located beyond the retracted position in the direction opposite to the axial direction, and wherein a passage of the cap from the retracted position to the deployed position is achieved by a movement of said cap relative to the assembly ring in the direction opposite to the axial direction until said cap reaches the second unstable position, followed by a movement of the cap relative to the assembly ring in the axial direction caused by the elastic element.

4. The system according to claim 2, wherein the reversible locking device comprises at least one follower pin integral to one among the assembly ring and cap and engaging with a heart-shaped cam integral to the other among the assembly ring and cap.

5. The system according to claim 1, the handling, element being movable relative to the neck of the product reservoir between the resting position and a usage position, said system further comprising a locking device that locks the handling element in the resting position when the cap is in the deployed position, a passage of said cap into the retracted position causing an unlocking of said handling element.

6. A retractable covering system suitable for covering a handling element protruding from a neck of a product reservoir, said retractable covering system comprising:

an assembly ring intended to be attached concentrically to the neck of the product reservoir, having a first longitudinal end intended to be placed facing the product reservoir and a second longitudinal end, and defining a longitudinal axis and an axial direction from the first longitudinal end to the second longitudinal end, said second longitudinal end being free;

a cap that is movable along the longitudinal axis relative to the assembly ring, between a deployed position where said cap substantially protrudes in the axial direction relative to said assembly ring and a retracted position where said cap is at least partially retracted in a direction opposite to the axial direction relative to said assembly ring;

an elastic element biasing the cap towards the deployed position; and a reversible locking device to lock the cap in the retracted position, wherein the reversible locking device defines at least a first stable position of the cap relative to the assembly ring, corresponding to the retracted position, and at least a first unstable position located beyond the retracted position in the direction opposite to the axial direction, wherein a passage of the cap from the deployed position to the retracted position is achieved by a movement of said cap relative to the assembly ring in the direction opposite to the axial direction until said cap reaches the first unstable position, followed by a movement of the cap relative to the assembly ring in the axial direction caused by the elastic element, wherein the reversible locking device comprises at least one follower pin integral to one among the assembly ring and cap and engaging with a heart-shaped cam integral to the other among the assembly ring and cap, and wherein the reversible locking device comprises at least one flexible tab having a free end provided with the follower pin, said flexible tab being inclined towards the longitudinal axis such that said follower pin exerts an elastic force in a radial direction on the heart-shaped cam.

7. A retractable covering system suitable for covering a handling element protruding from a neck of a product reservoir, said retractable covering system comprising:

an assembly ring intended to be attached concentrically to the neck of the product reservoir, having a first longitudinal end intended to be placed facing the product reservoir and a second free longitudinal end, and defining a longitudinal axis and an axial direction from the first longitudinal end to the second longitudinal end;

a cap that is movable along the longitudinal axis relative to the assembly ring, between a deployed position where said cap substantially protrudes in the axial direction relative to said assembly ring and a retracted position where said cap is at least partially retracted in a direction opposite to the axial direction relative to said assembly ring;

an elastic element biasing the cap towards the deployed position; and a reversible locking device to lock the cap in the retracted position;

wherein the handling element is movable relative to the neck of the product reservoir between a rest position and a usage position, said retractable covering system further comprising a locking device that locks the handling element in the rest position when the cap is in the deployed position, a passage of said cap into the retracted position causing an unlocking of said handling element, wherein the locking device for the handling element comprises at least one tiltable tongue integral to the assembly ring and having a locking portion, an unlocking portion, and tilt axis, said locking and unlocking portions extending to each side of the tilt axis, the locking portion engaging with the handling element when the cap is in the deployed position, and said cap being brought into engagement with the unlocking portion when passing from the deployed position to the retracted position so as to cause the tiltable tongue to tilt on the tilt axis and the locking portion to disengage from the handling element.

8. The system according to claim 7, wherein the locking device further comprises a tab integral to the assembly ring and extending substantially along the longitudinal axis, and wherein the tilt axis of the tiltable tongue is formed by at least one bridge of material connecting said tab and said tiltable tongue.

9. The system according to claim 7, wherein the locking portion comprises a lug extending radially inward and the unlocking portion comprises a ramp extending radially outward.

10. A product packaging and application assembly comprising:

a product reservoir having a neck extending along a longitudinal axis and having an open free end, a shoulder, a side wall, and a bottom, said shoulder radially connecting said neck to said side wall;

a product application device having a collection portion intended to be inserted through the open free end of the neck so as to extend at least partially inside the product reservoir, for collecting product contained therein, and a handling element protruding from said neck along the longitudinal axis and adapted to be manipulated by a user in order to act on the collection portion and cause product to exit the product reservoir, wherein the collection portion comprises a pump fixed to the neck of the product reservoir; and a retractable covering system suitable for covering the handling element protruding from the neck of the product reservoir, the handling element comprising a pushbutton, the push button being movable relative to the pump between a rest position and a pump actuation position;

an assembly ring concentrically fixed to the neck of the product reservoir, said assembly ring having a first longitudinal end facing the product reservoir and a second longitudinal end, said assembly ring further defining the longitudinal axis and an axial direction from the first longitudinal end to the second longitudinal end, said second longitudinal end being free; and a cap that is movable along the longitudinal axis relative to the assembly ring, between a deployed position where said cap substantially protrudes in the axial direction relative to said assembly ring and a retracted position where said cap is at least partially retracted in a direction opposite to the axial direction relative to said assembly ring said cap laterally covering the handling element in the deployed position and at least partially uncovering said handling element in the the retracted position;

an elastic element biasing the cap towards the deployed position; and a reversible locking device to lock the cap in the retracted position.

11. The assembly according to claim 10, wherein the pump is fixed to the neck of the reservoir by means of a ferrule engaged around and over the open free end of the neck of the reservoir, and wherein the assembly ring is fixed to said neck at least by being engaged around said ferrule.

* * * * *